United States Patent [19]

Dailey

[11] Patent Number: 4,939,858

[45] Date of Patent: Jul. 10, 1990

[54] PICTURE FRAME

[76] Inventor: Michael P. Dailey, 26 Preakness Ct., Lake Oswego, Oreg. 97035

[21] Appl. No.: 293,992

[22] Filed: Jan. 6, 1989

[51] Int. Cl.[5] ..... A47G 1/06

[52] U.S. Cl. ..... 40/152.1; 40/152

[58] Field of Search ..... 40/152, 152.1, 155, 40/156

[56] References Cited

U.S. PATENT DOCUMENTS

| | | | |
|---|---|---|---|
| 986,236 | 3/1911 | Soletcki . | |
| 1,361,678 | 12/1920 | Buck . | |
| 2,074,994 | 3/1937 | Stupell | 40/140 |
| 2,166,641 | 7/1939 | Perera et al. | 40/158 |
| 2,338,189 | 1/1944 | Libby et al. | 154/2 |
| 2,401,241 | 5/1946 | Grobholz | 40/152.1 |
| 2,623,316 | 12/1952 | Knox | 40/152 |
| 2,769,261 | 11/1956 | Lauglin | 40/152.1 |
| 2,782,541 | 2/1957 | Spertus | 40/152 |
| 3,184,873 | 1/1965 | Turner | 40/158 |
| 3,360,227 | 12/1967 | Overton et al. | 40/152.1 |
| 3,745,680 | 7/1975 | Faust | 40/156 |
| 3,916,549 | 11/1975 | Storch et al. | 40/152.1 |
| 4,030,220 | 6/1977 | Kotchen | 40/156 |
| 4,114,300 | 9/1978 | Holson | 40/152 |
| 4,164,085 | 8/1979 | Steeb et al. | 40/152 |
| 4,170,080 | 10/1979 | Bergh et al. | 40/152 |
| 4,286,400 | 9/1981 | MacPherson et al. | 40/152 |
| 4,422,252 | 12/1983 | Wicks | 40/159 |
| 4,434,567 | 3/1984 | LeVeau | 40/157 |

FOREIGN PATENT DOCUMENTS

| | | | |
|---|---|---|---|
| 202732 | 8/1923 | United Kingdom | 40/152.1 |
| 794772 | 5/1958 | United Kingdom | 40/152 |

*Primary Examiner*—Kenneth J. Dorner
*Assistant Examiner*—Brian K. Green
*Attorney, Agent, or Firm*—LaValle D. Ptak

[57] ABSTRACT

A picture frame is constructed in the form of a rectangular base member which has a raised outside edge around it, so that a first portion of the base member is located in a plane recessed from the edge. A second recessed portion for receiving a picture is located in the front face of the base member and is located in a plane recessed from the plane of the first portion. When a picture is placed in the second recessed portion, an inner clamping frame frictionally engages the edges of the second recessed portion to press against the edges of the picture to hold it in place. A decorative panel is removably placed over the first recessed portion between the outside edge of the base member and the edges of the second recessed portion. The clamping frame has a flange which overlies the first recessed portion around the edge of the second recessed portion, and this flange engages the removable decorative panel to hold it in place on the frame.

23 Claims, 2 Drawing Sheets

PICTURE FRAME

BACKGROUND

Picture frames made of a variety of different materials are extensively used for the purpose of displaying paintings, prints, photographs, and the like. Typically, the frames for any particular photograph or painting are selected to enhance the appearance of the picture displayed. Custom frames usually include an outer frame made of wood or other suitable material, in which one or more bordering mats are placed to surround the painting or picture located in the center. The mats typically are selected from colors which compliment or enhance the painting or picture in the display.

For custom picture framing, the effect of the mats in conjunction with the outside frame is the formation of a set of a series of borders around the picture displayed and increasing in size, with the frame constituting the final or outside border. The frame, the picture, and the bordering mats all are secured to one another, typically to a suitable backing which is attached to the frame. In some cases, a glass is provided behind the frame and over the mats and picture. Such custom frames are relatively expensive and the mats generally are custom cut to size for each individual requirement.

A large market exists for relatively inexpensive picture frames, typically used for displaying photographs or similar work. Such frames include an outer frame member, and usually a glass or transparent plastic is located behind the frame member and held in place by it. In some cases, the frame is designed to give the appearance of having a mat in it, or a separate mat is provided behind the glass. A back made of cardboard or other suitable material is designed to fit within the outer frame member, and additional cardboard or suitable spacers are provided; so that when a photograph is placed behind the glass, the spacers and the back hold everything in place. Usually a fold out stand is attached to or formed from the back, so that the frame is self standing on a flat surface. Picture frames of this type are considerably less expensive than the custom frames discussed above. A variety of different materials are used for the frame portion itself, although frequently the preferred materials are metal or plastic, because of the relative ease of mass production which is possible with such materials. The purchaser of such a frame is limited with respect to the effect of any matting surrounding the picture display area to the structure built into the frame itself. In addition, the open edge into which the picture, spacers and back typically are inserted has the possibility of permitting the back to slide out accidentally unless sufficient spacer materials are provided between the back and the picture to tightly wedge all of the pieces in place.

A different approach to a frame which permits the insertion of the material to be displayed from the front of the frame rather than the back (as is the case of both of the frames discussed above) is disclosed in the Kotchen U.S. Pat. No. 4,030,220. The Kotchen Patent shows a press-fit structure in which the frame is formed with a solid back, having an outwardly extending box-like structure around an opening in which the article to be displayed is placed. In Kotchen, the frame primarily is designed for the display of needle point which is supported on a rigid sheet. The needle point support sheet is press fit into the box-like frame from the front. A transparent protective sheet made of substantially rigid plastic is then press fit over the needle point through the front opening of the box-like frame member to permit display of the needle point. Once the needle point and the transparent cover sheet are pressed into the box, they are relatively difficult to remove, since they fit tightly inside the edges or side of the box.

A picture frame which is loaded from the front rather than the back is disclosed in the Steeb U.S. Pat. No. 4,164,085. Steeb is directed to a frame inset into the padded front cover of a photo album or the like. The cover has a solid backing layer on it. A sheet with a hole cut through it then is laminated onto this backing layer. A plastic tray is secured in the hole by means of adhesive and this tray has tabs on it for engaging mating tabs on an overlying border frame member. After the tray is in place, a picture may be placed on the tray. A glass cover plate then is placed over the picture and the overlying border frame is snapped into place. The end result is to produce a custom cover for the album in which a selected photograph or other picture is displayed.

The Buck U.S. Pat. No. 1,361,678 discloses a system for mounting dental x-ray photographs on a cardboard backing. The x-ray photographs are loosely placed within a metal frame which has a depending prong on each of its four sides. The frame is located over an opening in the cardboard backing, the prongs are pressed through the backing and are bent over on the reverse side. Consequently, the x-ray photograph then is held in place over the opening in the cardboard backing.

The MacPherson U.S. Pat. No. 4,286,400 discloses a picture frame which is formed with an outer rim and an inner rim around the picture display area to define a recess between the two rims. An insert is made to press fit into this recess. Decorative patterns of different colors and materials are wrapped around the insert which is pressed into place to provide a desired decorative covering or background surrounding the picture display area of the frame.

It is desirable to provide an efficient picture frame mounting and display system which is inexpensive, attractive, easy to use and which is readily adaptable to different decorative appearances.

SUMMARY OF THE INVENTION

It is an object of this invention to provide an improved picture frame structure;

It is another object of this invention to provide an improved front mounting picture frame structure;

It is an additional object of this invention to provide an improved front mounting picture frame structure which is simple to use to change the picture mounted therein;

It is a further object of this invention to provide an improved picture frame mounting structure utilizing a single element to hold the picture in place and to hold a removeable decorative panel in place.

In accordance with a preferred embodiment of this invention, a picture frame comprises a base member which has an outside edge and front and rear faces. The front face has a first portion located in a plane recessed from the edge, so that the edge extends perpendicularly beyond the plane of the first portion. A second smaller recessed portion, for receiving a picture, is located in the first portion in a plane which is recessed from the plane of the first portion a second predetermined distance. An inner clamping frame, which has a picture viewing opening in it, frictionally fits within the second recessed portion opening to press against a picture placed therein to hold the picture in place. This inner clamping frame also has flange which overlies the first portion around the periphery of the second recessed portion.

In a more specific embodiment of the invention, a decorative panel, having a thickness less than the first predetermined distance, is placed on the first portion and has an opening in it corresponding to the second portion; so that when the sub-frame clamping member is pressed into place to hold the picture in place, the flange around the periphery of the inner clamping frame also holds the decorative panel in place against the face of the first portion.

DETAILED DESCRIPTION

Figure 1:
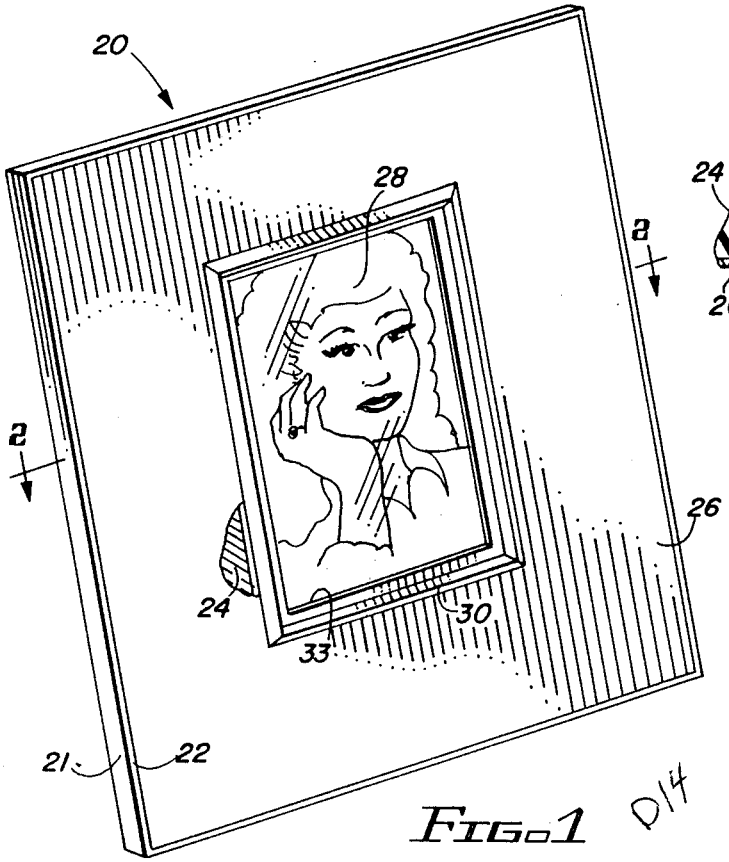
FIG. 1 is a perspective view of a preferred embodiment of the invention.

Reference now should be made to the drawings, in which the same reference numbers are used throughout the different figures to designate the same components. FIG. 1 illustrates a front perspective view of a preferred embodiment of a picture frame 20 in accordance with the invention. The frame 20 is illustrated as a type of frame which typically is used as a self standing frame for placement on a shelf or table surface.

Figure 7:
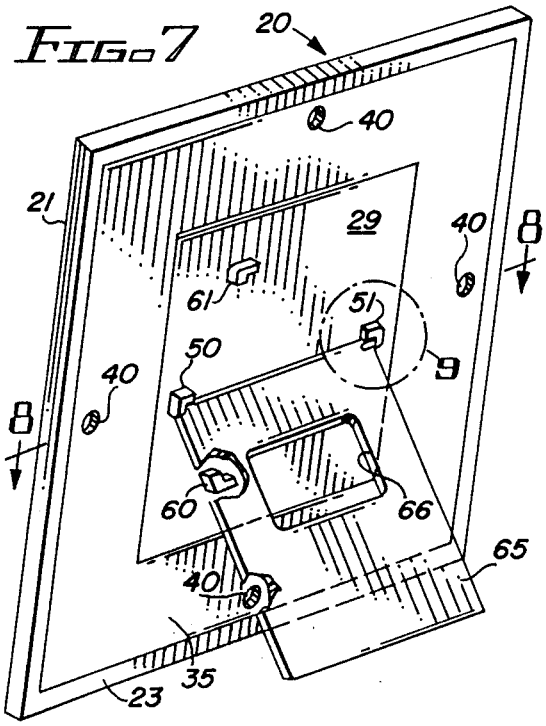
FIG. 7 is a back perspective view of the embodiment shown in FIG. 1.

The frame constitutes a base member with outside edges 21 on all four sides of the rectangular configuration shown in FIG. 1. The edges 21 have a front surface 22 lying in a first plane. Recessed from this front surface 22 of the edges 21 is a first portion 24 located on the front face of the frame 20. The surface of the portion 24 lies in a plane which is recessed a short distance (shown most clearly in FIG. 2) from the plane of the surfaces 22 of the edges 21. This surface 24 is used in the picture frame structure to provide a support for decorative panel 26 extending inwardly from the edges 21. A second recessed area 25 is provided in the center of the portion 24. This is shown most clearly in the enlarged view of FIG. 3. The recess 25 is a smaller rectangle than the outside dimensions of the frame 20 formed by the edges 21, and it is located essentially in the center of the frame 20, as illustrated in FIG. 1. Typically, the edges 21, the portion 24, and the recessed portion 25 all are molded from suitable plastic material as an integral molding. A raised area 29 may be provided on the reverse side of the recessed area 25, and the rear side of the edges 21 also may extend to terminate in a plane 23 which is the same plane as the raised area surface 29. This provides a recess about the portion 29 on the rear side of the frame. Typically, this recess is filled with a cardboard or fiber filler 35, as illustrated in FIGS. 2 and 7.

To use the frame described thus far, a photograph or other suitable picture 28, having external rectangular dimensions corresponding to the rectangular dimensions of the recessed portion 25 is placed in the portion 25. A decorative front panel 26 made of Mylar, semi-rigid paper stock (such as the type used for magazine covers or pages) or other suitable material is placed within the inner rectangle formed by the inside of the edges 21 to overlie the portion 24. The panel 26 is imprinted with a single color or a pattern, as desired. This decorative panel 26 has the inside cut out in a rectangular shape, corresponding to the dimensions of the second recessed area 25 in which the photograph 28 is placed.

Figure 3:
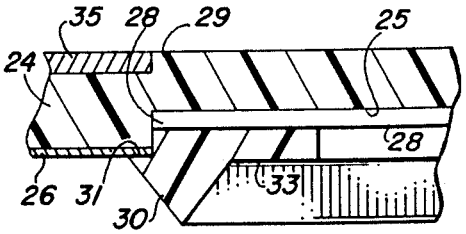
FIG. 3 is an enlarged view of the portion circled in FIG. 2.
Figure 2:
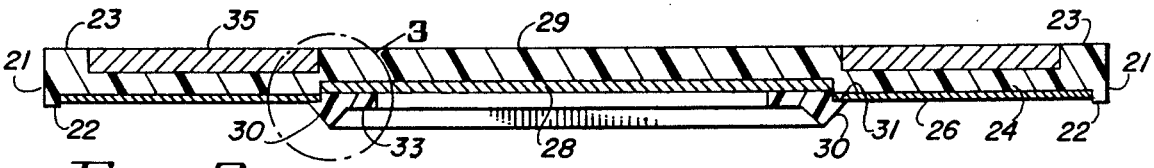
FIG. 2 is a cross-sectional view taken along the lines 2—2 of FIG. 1.

The panel 26 simply is laid in place over the portion 24, as illustrated in cross-section in FIGS. 2 and 3. The photograph 28 then is placed in the recess. An inner sub-frame or clamping frame 30 is pressed into place in the position shown in FIGS. 1, 2 and 3 to secure the photograph 28 in place in the recess 25 by pressing against the photograph around the edges (as shown most clearly in FIG. 3). The outside dimensions of the clamping frame 30 are arranged for a tight and secure frictional fit with the vertical edge formed by the recess 25 in the portion 24. This friction-fit interface is illustrated most clearly in FIGS. 2 and 3.

The clamping frame 30 has an overlapping flange edge 31 which engages the inner edge of the insert 26 and presses the insert 26 firmly against the edge of the portion 24 around the recess 25. The manner in which this is accomplished also is shown most clearly in FIG. 3. There is sufficient rigidity in a thin plastic panel or a light cardboard or paper panel 26 that the panel 26 is held in place over the surface 24 by the flange 31 without any adhesive applied to the rear surface of the panel 26.

Whenever the photograph 28 is to be changed, or whenever a new panel 26 is desired, the inner clamping frame 30 simply is pried out of engagement with the edges of the recess 25. The panel 26 and the photograph 28 then may be changed, as desired. A new panel 26 or a new photograph 28, or both, then may be placed in the frame, and everything is held together by simply pressing the clamping frame 30 into place as shown in FIG. 1.

The frame 30 also has an inward extension 33 which forms an additional matting effect for the overall frame structure. As shown most clearly in FIG. 2, the distance by which the portion 24 is recessed from the outer plane 22 of the edges 21 is selected to be equal to or greater than the thickness of the decorative panel 26. This protects the panel 26 from damage due to bumping or scraping of the frame and thereby preserves the appearance of the frame throughout its use.

Figure 4:
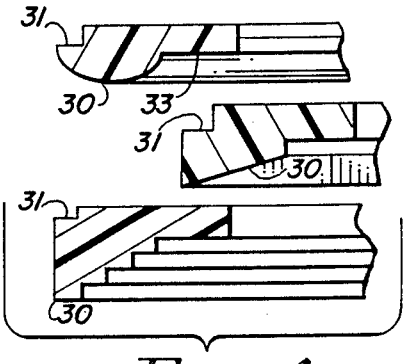
FIG. 4 shows alternative variations of a part of the type shown in FIG. 3.

FIG. 4 illustrates different cross-sectional configurations which may be employed for the inner clamping frame 30, which may be made of the same plastic material as the main frame member comprising the edges 21, portion 24 and recess portion 25. Generally, the main frame or base member and the inner clamping frame 30 are molded of material of the same color, although contrasting colors may be used. Generally, black, gold, or silver constitute the preferred colors for the base member of the frame 20 and the clamping frame 30. Variations in the esthetic effect of the frame 20 then are provided by the different colors, textures and patterns of the decorative panel inserts 26.

Figure 5:
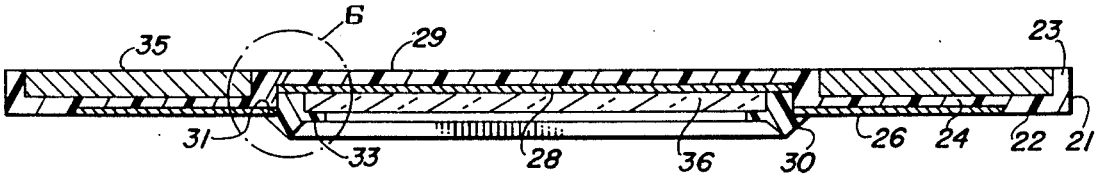
FIG. 5 is a cross-sectional view of a modification of the embodiment shown in FIG. 2.
Figure 6:
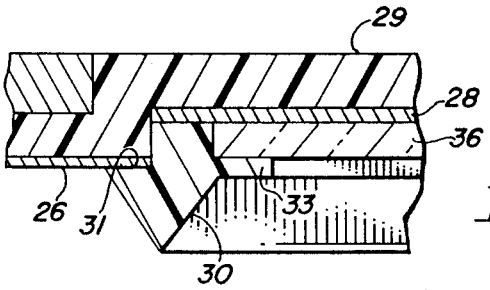
FIG. 6 is an enlarged detail of the portion circled in FIG. 5.

FIGS. 5 and 6 are directed to a variation of the structure of FIGS. 1 to 3, illustrating the manner in which a glass or transparent plastic cover plate 36 may be used over the photograph 28. Only a slight modification of the structure of the sub-frame clamping member 30 is necessary to accomodate this extra protective transparent plate sheet 36.

Reference now should be made to FIGS. 7 through 11, which show the back of a preferred embodiment of the frame 20 shown in FIG. 1. Two pairs of frame stand holding projection receiving members 50, 51 and 60, 61 are provided on the portion 29 of the frame. These members may be molded as an integral part of the base member of the frame 20. The pairs of projection receiving members, such as the members 50 and 51 are made to accomodate projections 67 and 68 on the upper edge of a rectangular stand 65.

Figure 8:
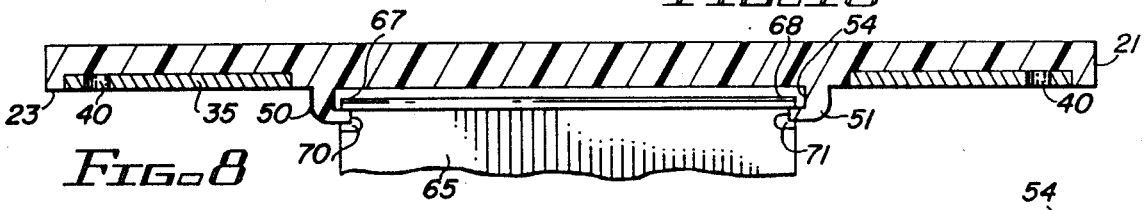
FIG. 8 is a cross-sectional view along the lines 8—8 of FIG. 7.

The stand 65 is also molded of plastic material and is substantially rigid, although it is capable of flexure at least along a line extending through its center longitudinally. To assist in the flexing of the stand 65, a rectangular cut-out 66 is provided, as shown most clearly in FIG. 7. Immediately adjacent each of the projections 67 and 68, is a recess 70 and 71 as illustrated in FIG. 8.

Figure 9:
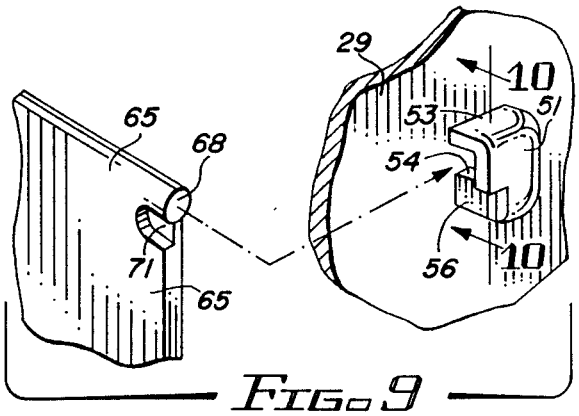
FIGS. 9 and 10 illustrate details of the portion circled in FIG. 7.
Figure 10:
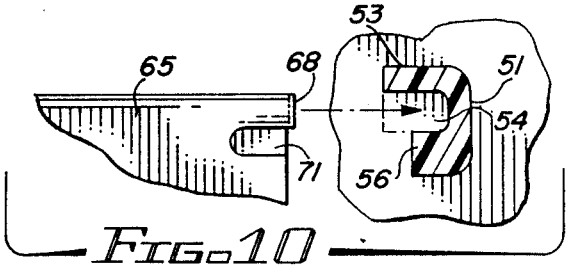

FIG. 9 is an enlarged detail of the projection 68 and the recess 71 and also of the projection receiving member 51. It is to be noted that the members 50, 51, 60 and 61 all are identical, so that the details which are illustrated in FIGS. 9 and 10 of the projection receiving member 51 apply equally as well to all of the other three similar projections.

It is apparent from an examination of FIG. 9 that the projection receiving member 51 extends outwardly from the rear surface 29 of the frame to provide a cavity 54. This cavity is closed on the top and includes a downwardly turned portion of the member 51 which terminates in a cut-away or relief portion 56 immediately below the cavity 54. The distance between the surface of the cut-away portion 56 and the similar cut-away portion on the projection receiving member 50 on the opposite side is equal to or slightly greater than the width of the stand 65. The projections 68 and 67 extend into the recesses 54 above this portion. Consequently, the stand 65 is free to rotate about an axis extending along the upper edge between the cut-out recesses in the projection receiving members 51 and 50. The limit of this rotation, however, is effected when the downwardly turned edges of the members 50 and 51 engage the recesses 70 and 71 on the stand 65 when the stand extends outwardly from the rear of the frame 20 at an angle of approximately 30° to 45°, as illustrated in FIG. 7. This also is illustrated in FIG. 8.

Figure 11:
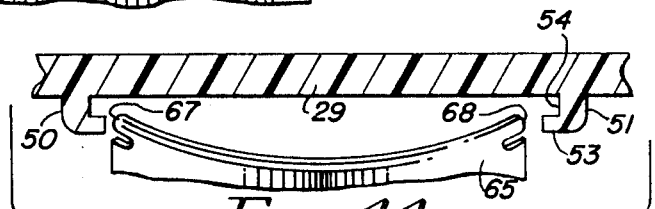
FIG. 11 illustrates the manner of assembling the parts of FIGS. 7 and 8.
Figure 12:
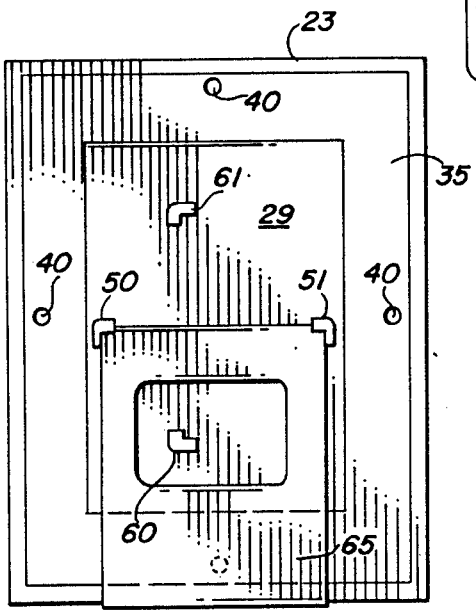
FIG. 12 shows a vertical orientation of the frame and stand of FIG. 7.
Figure 13:
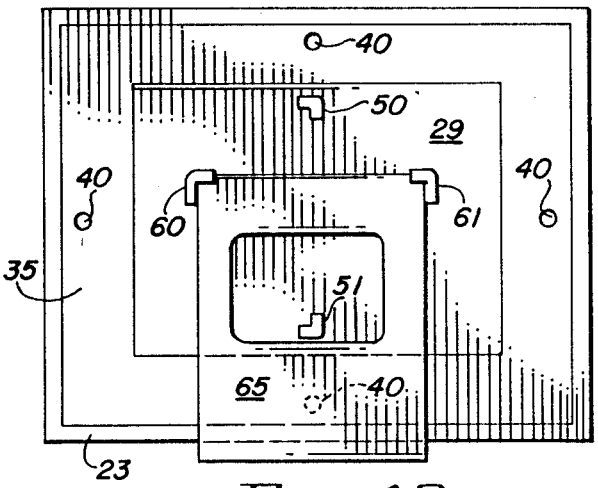
FIG. 13 shows a horizontal orientation of the frame and stand shown in FIG. 7.

FIG. 12 shows the configuration of the stand and frame when they are interconnected to provide the vertical orientation shown in FIGS. 1 and 7. By bending the stand member 65 about its longitudinal axis as shown in FIG. 11, the projections 67 and 68 may be removed from the recesses, such as the recess 54 in the projection receiving member 51 to insert or remove the stand 65. The frame then may be oriented horizontally as shown in FIG. 13, with the stand 65 bent as illustrated in FIG. 11 to insert the projections 67 and 68 into recesses in the members 60 and 61 which are similar to the one shown in detail for the extension 51, as described above. Consequently, the frame 20 may be oriented in either a vertical or a horizontal position to display a picture placed in the recess 25.

Alternatively, the frame 20 may be hung vertically or horizontally by engaging nails or hooks in holes 40 which are provided at the center of each of the sides in the cardboard or fiberboard filler 35 which is bonded in the recess between the raised portion 29 and the edges 23, as described previously.

The foregoing description of the preferred embodiment of the invention is to be considered illustrative and not as limiting. For example, materials other than the molded plastic material which has been described may be used if desired. Different arrangements for the self supporting stand also may be employed without departing from the scope of the invention. A variety of configurations for the clamping frame 30 may be employed in addition to the ones shown in FIGS. 3 and 4. The thickness of the decorative panel relative to the other components also may be varied, if desired. Other changes and modifications will occur to those skilled in the art without departing from the true scope of the invention as defined in the appended claims.

I claim:

1. A picture frame including in combination:

a one-piece unitary base member having an outside edge and a front surface having a first portion in a plane recessed from the outside edge, so that the edge of said base member extends a first predetermined distance perpendicularly beyond the plane of said first portion at a junction therewith;

a second recessed portion in said front surface of said base member and located within said first portion in a plane recessed from the plane of said first portion a second predetermined distance;

an inner clamping frame having a picture viewing opening therethrough, dimensioned for fitting within said second recessed portion, and having flange means overlying said first portion about the periphery of said second recessed portion.

2. The combination according to claim 1 wherein said base member is made of plastic material.

3. A combination according to claim 1 further including a decorative panel configured to fit between said second recessed portion and the junction of said first recessed portion with the edge of said base member such that the flange of said inner clamping frame overlies said panel and holds said panel in place on said first portion of said base member.

4. The combination according to claim 3 wherein said panel is removably held in place by said flange of said inner clamping frame pressing thereagainst about the periphery of said second recessed portion.

5. The combination according to claim 4 wherein the edges of said second recessed portion are perpendicular to the plane of said first recessed portion, and said inner clamping frame has a surface for frictionally engaging the edges of said second recessed portion.

6. The combination according to claim 1 wherein said inner clamping frame is dimensioned to be held frictionally in place contacting said second recessed portion.

7. The combination according to claim 1 wherein said inner clamping frame has a portion thereof for pressing against and holding in place a picture located in said second recessed portion.

8. The combination according to claim 1 further including a rigid transparent cover sheet placed in said second recessed portion overlying a picture therein and held in place by said inner clamping frame.

9. The combination according to claim 1 wherein said base member is rectangular and said second recessed portion is rectangular and substantially centered within said base member.

10. The combination according to claim 9 wherein said base member is a unitary molded plastic member.

11. A picture frame including in combination:

a unitary molded plastic member having an outside edge and a front surface having a first portion in a plane recessed from the outside edge, so that the edge of said base member extends a first predetermined distance perpendicularly beyond the plane of said first portion at a junction therewith;

a second recessed portion in said front surface of said base member and located within said first portion in a plane recessed from the plane of said first portion a second predetermined distance;

an inner clamping frame having a picture viewing opening therethrough, dimensioned for fitting within said second recessed portion, and having flange means overlying said first portion about the periphery of said second recessed portion.

12. The combination according to claim 11 wherein said base member is rectangular and said second recessed portion is rectangular and substantially centered within said base member.

13. The combination according to claim 11, further including a decorative panel configured to fit between said second recessed portion and the junction of said first recessed portion with the edge of said base member such that the flange of said inner clamping frame overlies said panel and holds said panel in place on said first portion of said base member.

14. The combination according to claim 13 wherein said decorative panel has a thickness equal to or less than said first predetermined distance.

15. The combination according to claim 14 wherein said inner clamping frame is dimensioned to be held frictionally in place contacting said second recessed portion.

16. The combination according to claim 15 wherein said second recessed portion has edges which are perpendicular to the plane of said first recessed portion, and said inner clamping frame has a surface for frictionally engaging the edges of said second recessed portion.

17. The combination according to claim 16 wherein said inner clamping frame has a portion thereof for pressing against and holding in place a picture located in said second recessed portion.

18. The combination according to claim 17 further including a rigid transparent cover sheet placed in said second recessed portion overlying a picture therein and held in place by said inner clamping frame.

19. A picture frame including in combination:

a one-piece unitary base member having an outside edge and a front surface having a first portion in a plane recessed from the edge, so that the edge of said base member extends a first predetermined distance perpendicularly beyond the plane of said first portion at a junction therewith;

a second recessed portion in said front surface of said base member and located within said first portion in a plane recessed from the plane of said first portion a second predetermined distance;

an inner clamping frame having a picture viewing opening therethrough, dimensioned for fitting within said second recessed portion, and having flange means overlying said first portion about the periphery of said second recessed portion;

a first pair of stand projection receiving members located on a rear surface of said base member for pivotally receiving a generally rectangular stand therein; and a second pair of stand projection receiving members located on the rear surface of said base member on a line perpendicular to the line between said first pair of projection receiving members and spaced apart the same distance as said first pair of projection receiving members for receiving said stand therein, so that said picture frame may be oriented in first and second orientations which are 90° offset from one another.

20. The combination according to claim 19 wherein said projection receiving members are integrally molded in said base member.

21. The combination according to claim 20 wherein said stand is a substantially rigid rectangular plastic member having projections thereon for engagement with said stand projection receiving members.

22. The combination according to claim 21 wherein said stand is capable of limited flexure along said one edge between the projections thereon for insertion between opposite corresponding ones of said pair of stand projection receiving members.

23. The combination according to claim 22 wherein said projection receiving members have facing extensions thereon and wherein said stand has mating recesses therein for engaging said extensions to determine the angle at which said stand extends outwardly from the plane of the rear face of said base member.

* * * * *